US009741307B2

(12) United States Patent
Park et al.

(10) Patent No.: US 9,741,307 B2
(45) Date of Patent: Aug. 22, 2017

(54) DISPLAY APPARATUS AND METHOD OF DRIVING THE SAME

(71) Applicant: SAMSUNG DISPLAY CO., LTD., Yongin-si, Gyeonggi-do (KR)

(72) Inventors: Kyungho Park, Suwon-si (KR); Young Gu Kim, Daejeon (KR); Suji Park, Seoul (KR); Yeongrong Park, Osan-si (KR); Baekkyun Jeon, Yongin-si (KR); Min-Sik Jung, Yongin-si (KR); Jaeweon Hur, Busan (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 35 days.

(21) Appl. No.: 14/848,481

(22) Filed: Sep. 9, 2015

(65) Prior Publication Data

US 2016/0247435 A1 Aug. 25, 2016

(30) Foreign Application Priority Data

Feb. 23, 2015 (KR) ..... 10-2015-0025356

(51) Int. Cl.
*G09G 3/36* (2006.01)

(52) U.S. Cl.
CPC ..... *G09G 3/3648* (2013.01); *G09G 3/3614* (2013.01); *G09G 2300/0434* (2013.01); *G09G 2320/0238* (2013.01); *G09G 2320/0257* (2013.01); *G09G 2320/041* (2013.01)

(58) Field of Classification Search
CPC ..... G09G 3/3614; G09G 3/3648; G09G 2320/041; G09G 2320/0238; G09G 2320/0257; G09G 2300/0434
See application file for complete search history.

(56) References Cited

U.S. PATENT DOCUMENTS

| | | | | |
|---|---|---|---|---|
| 6,063,829 | A | 5/2000 | Endou et al. | |
| 2005/0200619 | A1* | 9/2005 | Adachi | G09G 3/2025 345/204 |
| 2008/0284768 | A1* | 11/2008 | Yoshida | G09G 3/2022 345/208 |

FOREIGN PATENT DOCUMENTS

| | | |
|---|---|---|
| JP | 2008-116809 | 5/2008 |
| JP | 2012-093642 | 5/2012 |
| KR | 1020020071525 | 9/2002 |
| KR | 1020030073071 | 9/2003 |
| KR | 1020080018558 | 2/2008 |
| KR | 1020090072885 | 7/2009 |
| KR | 1020090113409 | 11/2009 |

* cited by examiner

*Primary Examiner* — Charles Hicks
(74) *Attorney, Agent, or Firm* — F. Chau & Associates, LLC

(57) ABSTRACT

A display apparatus includes a timing controller for converting data values of black image signals to have one polarity with respect to a common voltage and for converting data values of low gray scale image signals to have one polarity with respect to the common voltage, a data driver for converting the image signals outputted from the timing controller into data voltages, and a plurality of pixels for receiving the data voltages in response to gate signals to display an image. The low gray scale image signals displays a gray scale equal to or less than a reference gray scale at a surrounding temperature lower than a reference temperature.

19 Claims, 12 Drawing Sheets

DISPLAY APPARATUS AND METHOD OF DRIVING THE SAME

CROSS-REFERENCE TO RELATED APPLICATION

This U.S. non-provisional patent application claims priority under 35 U.S.C. §119 to Korean Patent Application No. 10-2015-0025356, filed on Feb. 23, 2015, the disclosure of which is incorporated by reference herein in its entirety.

TECHNICAL FIELD

The present inventive concept relates to a display apparatus and a method of driving the display apparatus.

DISCUSSION OF RELATED ART

A liquid crystal display apparatus is a flat panel display apparatus that can display images by using a liquid crystal layer. Liquid crystal molecules in the liquid crystal layer may be aligned in a predetermined direction in the absence of an electric filed by using a photo-alignment method in which an alignment layer is treated with ultraviolet (UV) light.

In a plane-to-line switching (PLS) mode liquid crystal display apparatus, the liquid crystal molecules are aligned in parallel to a substrate and rotate almost parallel to the substrate when driven. Therefore, in the PLS mode liquid crystal display apparatus, the liquid crystal molecules may not need a pre-tilt angle, and thus the photo-alignment method with UV light may be applied to the PLS mode liquid crystal display apparatus.

The photo-alignment method may have a higher contrast ratio than that of a rubbing method. However, in the photo-alignment method, an alternating current (AC) afterimage may be generated due to a deformation of the alignment layer or relatively low alignment ability compared to the rubbing method. In addition, a direct current (DC) afterimage may be generated by ion particles accumulating in the liquid crystal layer on a pixel electrode when a DC voltage is applied.

When a specific pattern is displayed for a long time and then moved to another screen, the specific pattern may be seen as the afterimage due to the AC afterimage or the DC afterimage. The afterimage may be seen in a low gray scale, but not be seen in a high gray scale.

SUMMARY

Exemplary embodiments of the inventive concept provide a display apparatus including: a timing controller for converting data values of black image signals to have one polarity with respect to a common voltage and for converting data values of low gray scale image signals to have one polarity with respect to the common voltage, a data driver for converting the image signals outputted from the timing controller into data voltages, and a plurality of pixels for receiving the data voltages in response to gate signals to display an image. The low gray scale image signals displays a gray scale equal to or less than a reference gray scale at a surrounding temperature lower than a reference temperature.

In an exemplary embodiment of the inventive concept, the timing controller may include a data processing unit for converting the data values of the black image signals to have one polarity with respect to the common voltage and the data values of the low gray scale image signals to have one polarity with respect to the common voltage at a first surrounding temperature, but not converting the data values of the low gray scale image signals at a second surrounding temperature, thereby outputting the converted black image signals and the low gray scale image signals. The first surrounding temperature is lower than the reference temperature and the second surrounding temperature is equal to or higher than the reference temperature.

In an exemplary embodiment of the inventive concept, the data processing unit may include a temperature measurement part for measuring and outputting a temperature information, and a data value conversion part for converting the data values of the black image signals to have one polarity with respect to the common voltage and the data values of the low gray scale image signals to have one polarity with respect to the common voltage at a first surrounding temperature but not converting the data values of the low gray scale image signals at the second a surrounding temperature, thereby outputting the converted black image signals and the low gray scale image signals.

In an exemplary embodiment of the inventive concept, a level of the data voltages corresponding to the black image signals may be less than about 500 mV.

In an exemplary embodiment of the inventive concept, a number of the reference gray scale may be 32 when a number of full white is 64.

In an exemplary embodiment of the inventive concept, the reference temperature may be about 40° C.

In an exemplary embodiment of the inventive concept, the data processing unit may convert the data values of the black image signals to have a positive polarity with respect to the common voltage.

In an exemplary embodiment of the inventive concept, the data processing unit may convert the data values of the low gray scale image signals at the first surrounding temperature to have a negative polarity with respect to the common voltage.

In an exemplary embodiment of the inventive concept, each of the pixels may include a first substrate and a second substrate disposed to face each other, and a liquid crystal layer disposed between the first and second substrates. The first substrate may include a transistor receiving a corresponding data voltage of the data voltages in response to a corresponding gate signal of the gate signals, a pixel electrode receiving the data voltage through the transistor, and a common electrode disposed to be insulated from the pixel electrode. The pixel electrode may include a plurality of branch parts spaced a predetermined distance apart from each other in a first direction to extend in a second direction that intersects the first direction, a first connection part connecting first sides of the branch parts to each other, and a second connection part connecting second sides of the branch parts to each other.

In an exemplary embodiment of the inventive concept, a method of driving a display apparatus includes: converting data values of black image signals to have one polarity with respect to a common voltage, converting and outputting low gray image signals at a first surrounding to have one polarity with respect to the common voltage, but not converting the gray image signals at a second surrounding temperature, converting the outputted image signals into data voltages, and providing the data voltages to pixels in response to gate signals. The gray scale image signals displays a gray scale equal to or less than a reference gray scale. The first surrounding temperature is lower than the reference temperature and the second surrounding temperature is equal to or higher than the reference temperature.

In an exemplary embodiment of the inventive concept, the method further comprises measuring the first and second surrounding temperatures.

In an exemplary embodiment of the inventive concept, a level of the data voltages corresponding to the black image signal is less than about 500 mV.

In an exemplary embodiment of the inventive concept, a number of the reference gray scale is 32 when a number of full white is 64.

In an exemplary embodiment of the inventive concept, the reference temperature is about 40° C.

In an exemplary embodiment of the inventive concept, the data values of the black image signals are converted to have a positive polarity with respect to the common voltage.

In an exemplary embodiment of the inventive concept, the data values of the low gray scale image signals are converted at the first surrounding temperature to have a negative polarity with respect to the common voltage.

In an exemplary embodiment of the inventive concept, each of the pixels comprises: a first substrate and a second substrates disposed to face each other; and a liquid crystal layer disposed between the first and second substrates, the first substrate comprises: a transistor receiving a corresponding data voltage of the data voltages in response to a corresponding gate signal of the gate signals; a pixel electrode receiving the data voltage through the transistor; and a common electrode disposed to be insulated from the pixel electrode, the pixel electrode comprises: a plurality of branch parts spaced a predetermined distance apart from each other in a first direction to extend in a second direction that intersects the first direction; a first connection part connecting first sides of the branch parts to each other; and a second connection part connecting second sides of the branch parts to each other.

In an exemplary embodiment of the inventive concept, a display apparatus is provided that includes: a plurality of pixels configured to receive data voltages in response to gate signals to display an image; a timing controller configured to convert data values of black pattern image signals so that the black pattern image signals are biased to one first polarity with respect to a common voltage and for converting data values of low gray scale image signals so that the low gray scale image signals are biased to one polarity with respect to the common voltage; and a data driver configured to convert the image signals received from the timing controller into the data voltages to provide the data voltages to the pixels.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EMBODIMENTS

Figure 1:
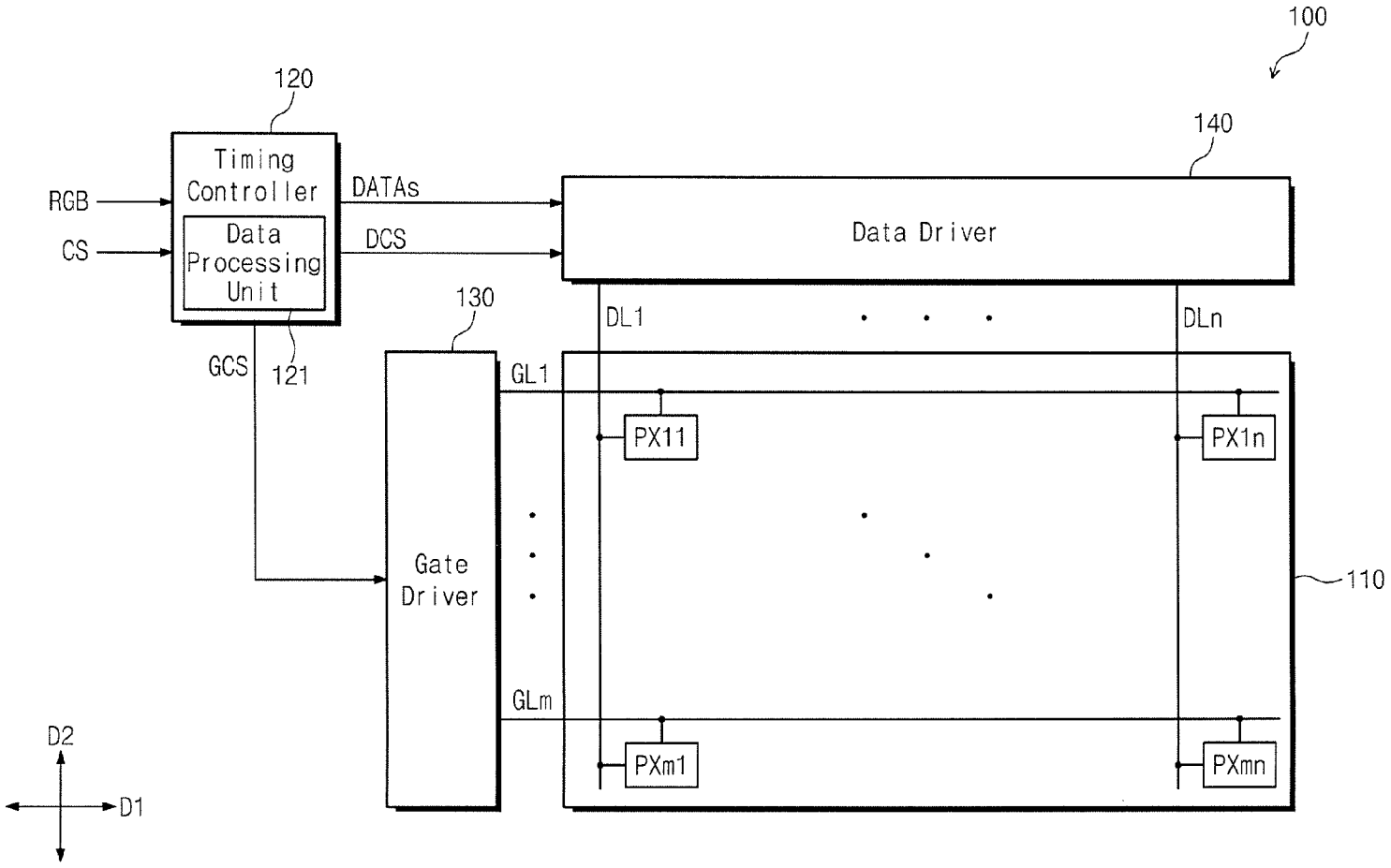
FIG. 1 is a block diagram of a display apparatus according to an exemplary embodiment of the inventive concept.

Exemplary embodiments of the inventive concept will now be described more fully hereinafter with reference to the accompanying drawings. The inventive concept, however, may be embodied in various forms and should not be construed as being limited to only the illustrated embodiments. Like reference numerals may refer to like elements throughout the specification.

It will be understood that when an element such as a layer is referred to as being "on" another element, it can be directly on the other element or intervening elements may also be present.

Additionally, exemplary embodiments in the detailed description may be described with sectional views as ideal exemplary views of the inventive concept. Accordingly, shapes of the exemplary views may be modified according to manufacturing techniques and/or allowable errors. Therefore, the exemplary embodiments of the inventive concept are not limited to the specific shape illustrated in the exemplary views, but may include other shapes that may be created according to manufacturing processes. Areas exemplified in the drawings have general properties, and are used to illustrate a specific shape of a region of the element. Thus, this should not be construed as limiting the scope of the inventive concept.

FIG. 1 is a block diagram of a display apparatus according to an exemplary embodiment of the inventive concept.

Referring to FIG. 1, a display apparatus 100 according to an exemplary embodiment of the inventive concept includes a display panel 110, a timing controller 120, a gate driver 130, and a data driver 140.

The display panel 110 includes a plurality of gate lines GL1 to GLm, a plurality of data lines DL1 to DLn, and a plurality of pixels PX11 to PXmn. The gate lines GL1 to GLm extend in a first direction D1 and thus are connected to the gate driver 130. The data lines DL1 to DLn extend in a second direction D2 that intersects the first direction D1 and thus are connected to the data driver 140. Here, reference symbols m and n are natural numbers.

The pixels PX are disposed on areas partitioned by the gate lines GL1 to GLm and the data lines DL1 to DLn that cross each other. Thus, the pixels PX may be arranged in a matrix form. The pixels PX are connected to the gate lines GL1 to GLm and the data lines DL1 to DLn.

The timing controller 120 may receive image signals RGB and a control signal CS from the outside, for example, a system board. The timing controller 120 may correct and output data values (or gray scale data values) of the image signals RGB to improve afterimages in a low gray scale. When full white is 64 gray scales, the low gray scale may be a gray scale equal to or less than 32 gray scales that is defined as a reference gray scale.

The timing controller 120 may include a data processing unit 121 for correcting the data values of the image signals to improve the afterimages in the low gray scale. The data processing unit 121 may convert black pattern image signals, which display a black pattern, of the image signals RGB so that the data values of the black pattern image signals are biased to one polarity.

In addition, the data processing unit 121 may not convert the data values of the low scale image signals when a surrounding temperature is higher than a reference temperature, or not convert the image signals RGB which are low scale image signals that display the low scale. The data processing unit 121 may convert the data values of the low scale image signals so that the data values of the low scale image signals are biased to one polarity, when the surrounding temperature is lower than the reference temperature, and convert the image signals RGB which are the low scale image signals. A configuration and operation of the data processing unit 121 will be described in detail below.

The timing controller 120 may convert a data format of the image signals RGB to match an interface specification with the data driver 140. The timing controller 120 may provide the image data DATAs in which the data format is converted to the data driver 140.

The timing controller 120 may generate a gate control signal GCS and a data control signal DCS in response to the control signal CS. The gate control signal GCS is a control signal for controlling an operation timing of the gate driver 130. The data control signal DCS is a control signal for controlling an operation timing of the data driver 140.

The timing controller 120 may provide the gate control signal GCS to the gate driver 130 and the data control signal DCS to the data driver 140.

The gate driver 130 may generate gate signals in response to the gate control signal GCS. The gate driver 130 may successively output the gate signals. The gate signals are provided to the pixels PX11 to PXmn in a row unit through the gate lines GL1 to GLm.

The data driver 140 may generate analog type data voltages corresponding to the image data DATAs in response to the data control signal DCS. The data voltages are provided to the pixels PX11 to PXmn through the data lines DL1 to DLn The pixels PX11 to PXmn may receive the data voltages in response to the gate signals. The pixels PX11 to PXmn may display a gray scale corresponding to the data voltages to display the image.

The timing controller 120 may be mounted on a printed circuit board in an integrated circuit chip and thus be connected to the gate driver 130 and the data driver 140.

Each of the gate driver 130 and the data driver 140 may be provided with a plurality of driving chips and mounted on a flexible printed circuit board (PCB). In addition, the gate driver 130 and the data driver 140 may be connected to the display panel 110 in a tape carrier package (TCP) manner.

However, the present inventive concept is not limited thereto. For example, each of the gate driver 130 and the data driver 140 may be provided with the plurality of driving chips and thus be mounted on the display panel 110 in a chip on glass (COG) manner. In addition, the gate driver 130 may be simultaneously provided together with transistors of the pixels PX11 to PXmn and thus be mounted on the display panel 110 in an amorphous silicon TFT gate driver circuit (ASG) manner.

Figure 2:
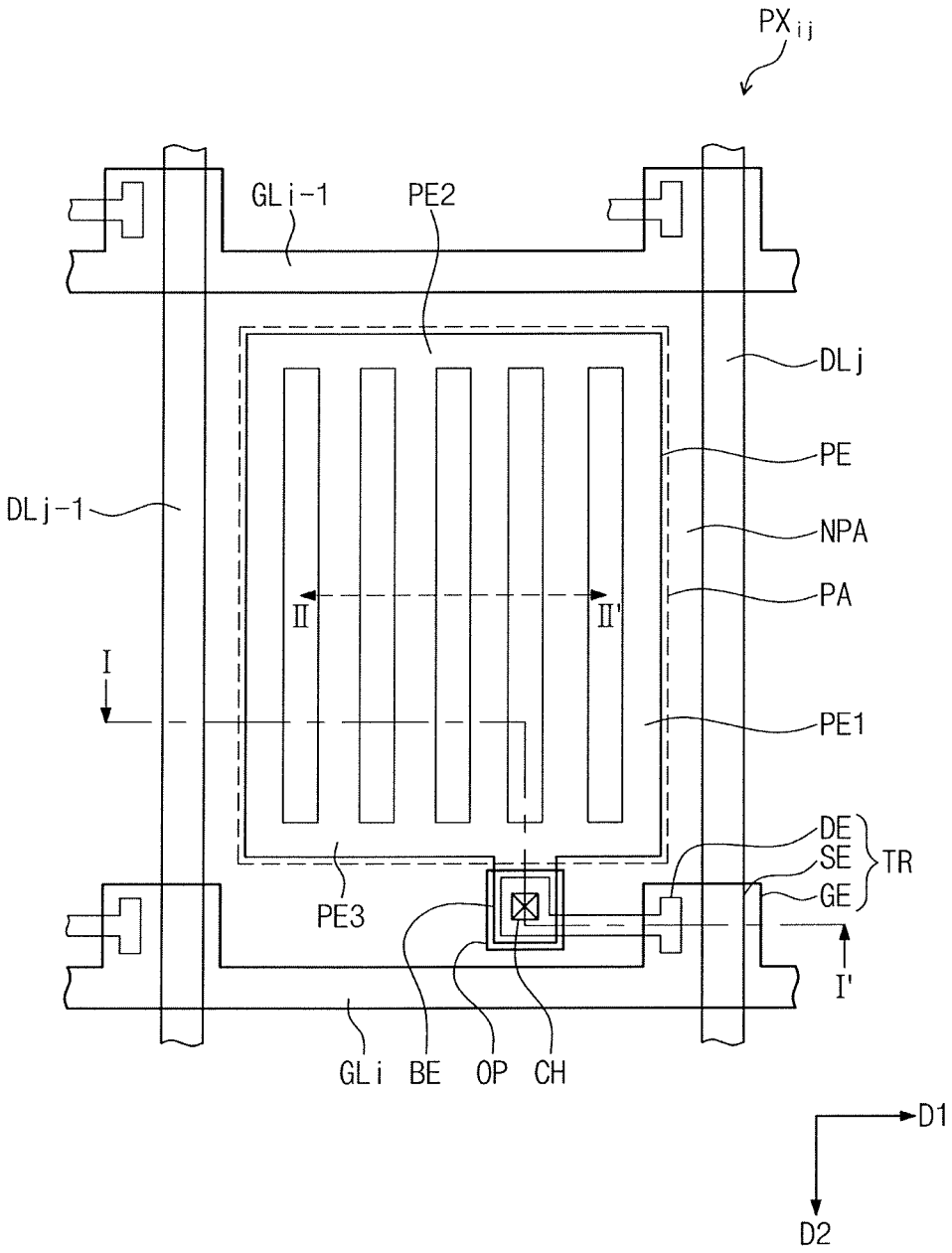
FIG. 2 is a plane view of one pixel of FIG. 1, according to an exemplary embodiment of the inventive concept.

FIG. 2 is a plane view of one pixel of FIG. 1, according to an exemplary embodiment of the inventive concept.

Although one pixel PXij is illustrated in FIG. 2, other pixels illustrated in FIG. 1 may have the same configurations those of the one pixel PXij of FIG. 2. Hereinafter, configurations of the one pixel PXij will be described for convenience of description.

Referring to FIG. 2, a planar area of the pixel PXij includes a pixel area PA and a non-pixel area NPA around the pixel area PA. The pixel area PA may be an area on which an image is displayed, and the non-pixel area NPA may be an area on which the image is not displayed.

The gate lines GLi-1 and GLi and the data lines DLj-1 and DLj may be disposed on the non-pixel area NPA. The gate lines GLi-1 and GLi may extend in the first direction D1. The data lines DLj-1 and DLj may extend in the second direction D2 to cross the gate lines GLi-1 and GLi. The data lines DLj-1 and DLj may be insulated from the gate lines GLi-1 and GLi. Reference symbol i is an integer that is greater than zero and equal to or less than the natural number m. Reference symbol j is an integer that is greater than zero and equal to or less than the natural number n.

The pixel PXij may include a transistor TR disposed on the non-pixel area NPA, and a pixel electrode PE disposed on the pixel area PA and connected to the transistor TR. The transistor TR may be connected to a corresponding gate line GLi of the gate lines GLi-1 and GLi and a corresponding data line DLj of the data lines DLj-1 and DLj.

The transistor TR may include a gate electrode GE connected to the gate line GLi, a source electrode SE connected to the data line DLj, and a drain electrode DE connected to the pixel electrode PE.

The gate electrode GE may be branched from the gate line GLi. The source electrode SE may be defined as one portion of the data line DLj overlapping the gate electrode GE. The drain electrode DE may overlap the gate electrode GE and be spaced apart from the source electrode SE. The drain electrode DE may extend to be electrically connected to the pixel electrode PE through a contact hole CH.

The pixel electrode PE may extend to the non-pixel area NPA and thus be connected to the drain electrode DE of the transistor TR through the contact hole CH. In detail, a branch electrode BE branched from the pixel electrode PE is connected to the drain electrode DE of the transistor TR through the contact hole CH. The branch electrode BE may be disposed on the non-pixel area NPA.

The pixel electrode PE may include a plurality of branch parts PE1, a first connection part PE2, and a second connection part PE3. The plurality of branch parts PE1 may extend in the second direction D2 and be disposed a predetermined space apart from each other in the first direction D1. The first and the second connection parts PE2 and PE3 may extend in the first direction DR1. The first connection part PE2 connects one sides of the second direction D2 of the branch parts PE1 to each other. The second connection part PE3 connects the other sides of the second direction D2 of the branch parts PE1 to each other.

A common electrode may be disposed on the pixel PXij. The common electrode may include an opening part OP. The opening part OP may have a size that is greater than that of the contact hole CH on a plane. These configurations will be described in detail.

Figure 3:
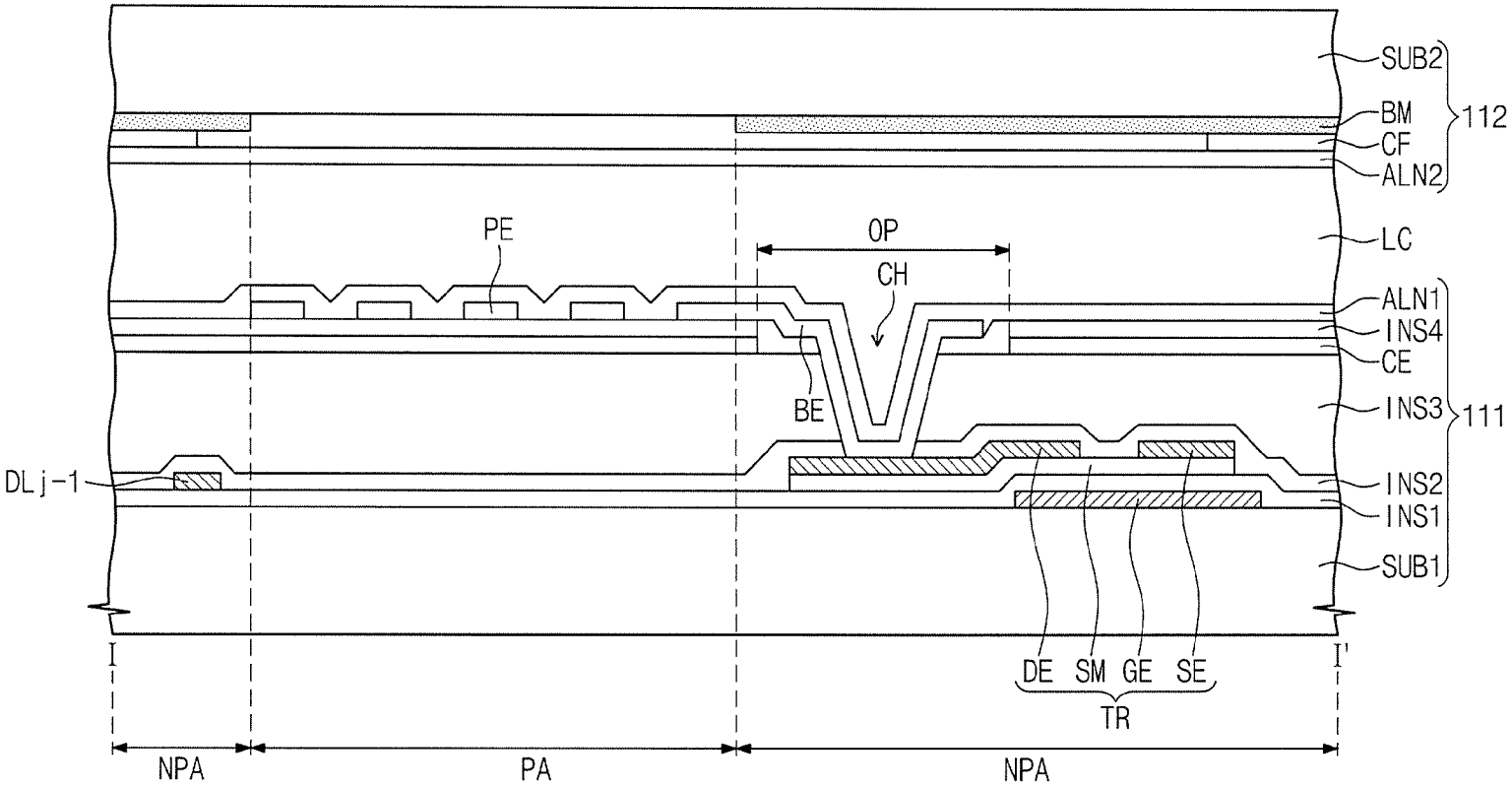
FIG. 3 is a cross-sectional view taken along line I-I' of FIG. 2, according to an exemplary embodiment of the inventive concept.

FIG. 3 is a cross-sectional view taken along line I-I' of FIG. 2, according to an exemplary embodiment of the inventive concept.

Referring to FIG. 3, the display panel 110 includes a first substrate 111, a second substrate 112 disposed to face the first substrate 111, and a liquid crystal layer LC disposed between the first substrate 111 and the second substrate 112. The plurality of pixels PX11 to PXnm may be disposed on the first substrate 111.

The first substrate 111 may include a first base substrate SUB1, the transistor TR, first to fourth insulation layers INS1 to INS4, a common electrode CE, the pixel electrode PE, and a first alignment layer ALN1. A planar area of the first base substrate SUB1 includes pixel areas PA and non-pixel areas NPA around the pixel areas PA.

The gate electrode GE of the transistor TR branched from the gate line GLi is disposed on the first base substrate SUB1 of the non-pixel area NPA. The first insulation layer INS1 is disposed on the first base substrate SUB1 to cover the gate electrode GE. The first insulation layer INS1 may be a gate insulation layer containing an inorganic material.

A semiconductor layer SM of the transistor TR is disposed on the first insulation layer INS1 in the non-pixel area NPA. The semiconductor layer SM has a predetermined area that overlaps the gate electrode GE. The semiconductor layer SM may include an active layer and an ohmic contact layer.

The source electrode SE and the drain electrode DE may be disposed to be spaced apart from each other on the semiconductor layer SM. The semiconductor layer SM may define a conductive channel between the source electrode SE and the drain electrode DE.

The second insulation layer INS2 may be disposed on the first insulation layer INS1 to cover the source electrode SE, the drain electrode DE, and the data line DLj-1. The second insulation layer INS2 may be defined as a passivation layer containing an inorganic material. The second insulation layer INS2 may cover an upper portion of the exposed semiconductor layer SM.

The third insulation layer INS3 containing an organic material may be disposed on the second insulation layer INS2. The third insulation layer INS3 may flatten an upper portion of the transistor TR.

The common electrode CE may be disposed on the third insulation layer INS3. The common electrode CE may include the opening part OP in which the common electrode CE is not disposed. The opening part OP may be disposed on the non-pixel area NPA.

The common electrode CE may be formed of a transparent conductive material. For example, the common electrode CE may include a transparent conductive metal oxide such as indium tin oxide (ITO), indium zinc oxide (IZO), and indium tin zinc oxide (ITZO). The fourth insulation layer INS4 containing an inorganic material may be disposed on the third insulation layer INS3 to cover the common electrode CE.

The contact hole CH exposing a predetermined area of the drain electrode DE of the transistor TR may pass through the fourth, third, and second insulation layers INS4, INS3, and INK. The contact hole CH may overlap the opening part OP of the common electrode CE. The contact hole CH may have a planar area that is less than that of the opening part OP.

The pixel electrode PE is disposed on the fourth insulation layer INS4 in the pixel area PA. The fourth insulation layer INS4 may electrically insulate the pixel electrode PE from the common electrode CE. The branch electrode BE branched from the pixel electrode PE may be electrically connected to the drain electrode DE of the transistor TR through the contact hole CH.

Since the common electrode CE has the opening part OP having a size greater than the planar area of the contact hole CH, the branch electrode BE and the common electrode CE may not be short-circuited even though the branch electrode BE branched from the pixel electrode PE is connected to the drain electrode DE through the contact hole CH.

Each of the pixel electrode PE and the branch electrode BE may be formed of a transparent conductive material. For example, each of the pixel electrode PE and the branch electrode BE may include a transparent conductive metal oxide such as indium tin oxide (ITO), indium zinc oxide (IZO), indium tin zinc oxide (ITZO).

A first alignment layer ALN1 may be disposed on the fourth insulation layer INS4 to cover the pixel electrode PE. The first alignment layer ALN1 may be aligned in a predetermined direction by a photo-alignment method.

The second substrate 112 may include a second base substrate SUB2, a black matrix BM, and a plurality of color filters CF. The second base substrate SUB2 is disposed to face the first base substrate SUB1.

The black matrix BM is disposed under the second base substrate SUB2 in the non-pixel area NPA. The color filters CF are disposed under the second base substrate SUB2 to respectively correspond to the pixels PX11 to PXnm. The color filters CF may be disposed to be covered by the black matrix BM.

Each of the color filters CF may provide a color to light penetrating the corresponding pixel of the pixels. The color filter CF may be one of a red color filter, a green color filter, and a blue color filter.

The black matrix BM may block unnecessary light to realize the image. The black matrix BM may prevent light leakage due to abnormal behavior of liquid crystal molecules at or near an edge of the pixel area PA or a color mix at or near an edge of the color filter CF.

A second alignment layer ALN2 is disposed under the color filters CF. The second alignment layer ALN2 may include the same material as that of the first alignment layer ALN1. The second alignment ALN2 may be aligned according to the same process as that of the first alignment layer ALN1.

As illustrated in FIGS. 2 and 3, the display apparatus 100 in which the pixel electrode PE and the common electrode CE are disposed may be a plane to line switching (PLS) mode liquid crystal display apparatus.

The transistor TR may be turned on in response to the gate signal received from the gate line GLi. The turned on transistor TR may receive the data voltage from the data line DLj to provide the received data voltage to the pixel electrode PE. The common electrode CE may receive a common voltage.

Fringe electric fields may be formed by the pixel electrode PE to which the data voltage is applied and the common electrode CE to which the common voltage is applied. The liquid crystal molecules of the liquid crystal layer LC may be driven by the fringe electric fields. Light transmittivity may be adjusted by the liquid crystal molecules driven by the fringe electric fields to display the image.

Figure 4:
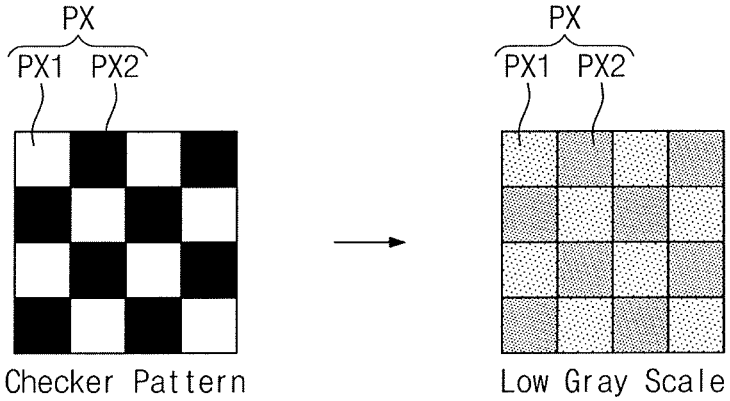
FIG. 4 is a view illustrating an afterimage phenomenon occurring on a plane-to-line switching (PLS) mode liquid crystal display apparatus.
Figure 5:
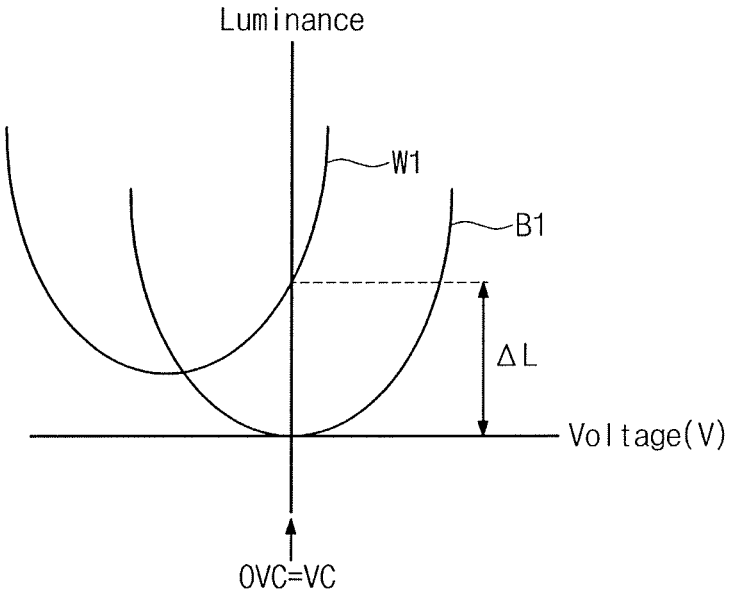
FIG. 5 is a view illustrating a luminance graph of first and second pixels displaying a low gray scale of FIG. 4.

FIG. 4 is a view illustrating an afterimage phenomenon occurring on a PLS mode liquid crystal display apparatus, and FIG. 5 is a view illustrating a luminance graph of a first and a second pixels displaying a low gray scale of FIG. 4.

In FIG. 4, for convenience of description, the pixels PX arranged in four rows and four columns are illustrated. The luminance graph illustrated in FIG. 5 is the luminance graph of the pixels PX measured at a temperature of about 60° C.

Referring to FIGS. 4 and 5, the pixels PX may include a plurality of first pixels PX1 and a plurality of second pixels PX2. The first and second pixels PX1 and PX2 are alternately disposed in a row direction and a column direction that crosses the row direction.

Data voltages having a white gray scale may be applied to the first pixels PX1, and data voltages having a black gray scale may be applied to the second pixels PX2, and thus the pixels PX may display a checker pattern. After this checker pattern is displayed for a long time, the pixels PX may display a low gray scale.

A first white curve W1 illustrated in FIG. 5 represents a luminance curve of the first pixel PX1 when the first pixel PX1 displays the low gray scale after displaying the white gray scale of the checker pattern. A first black curve B1 illustrated in FIG. 5 represents a luminance curve of the second pixel PX2 when the second pixel PX displays the low gray scale after displaying the black gray scale of the checker pattern.

In FIG. 5, an optimal common voltage OVC may be an intermediate level of a positive data voltage and a negative data voltage outputted from the data driver 140. The common voltage VC is a voltage that is applied to the common electrode CE. When the positive data voltage has the same intensity (or amplitude) as that of the negative data voltage with respect to the common voltage VC, the optimal common voltage OVC may have the same level as that of the common voltage.

In the luminance graph illustrated in FIG. 5, a position at which a user sees the image may be a point having the common voltage VC level. As illustrated in FIG. 5, a luminance difference ΔL may be generated between luminance of the first pixels PX1 represented by the first white curve W1 and luminance of the second pixels PX2 represented by the first black curve B1. In this case, the luminance difference ΔL between the first and second pixels PX1 and PX2 may be seen.

In other words, as illustrated in FIG. 4, the low gray scale is displayed after the checker pattern is displayed. The checker pattern may be a pre-displayed image that may be seen on an image displaying the low gray scale. This afterimage may be maintained for a predetermined time. To prevent the afterimage, there should be no luminance difference between the first pixels PX1 and the second pixels PX2.

FIGS. 6A, 6B, 6C, 7A, 7B and 7C are views explaining a direct current (DC) accumulation phenomenon.

Figure 6A:
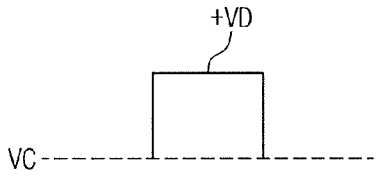
FIGS. 6A, 6B, 6C, 7A, 7B and 7C are views explaining a direct current (DC) accumulation phenomenon.
Figure 6B:
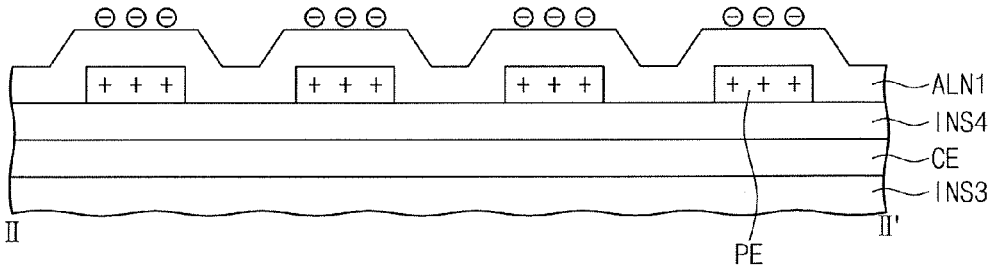
Figure 7A:
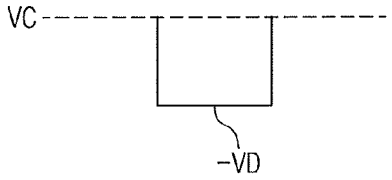
Figure 7B:
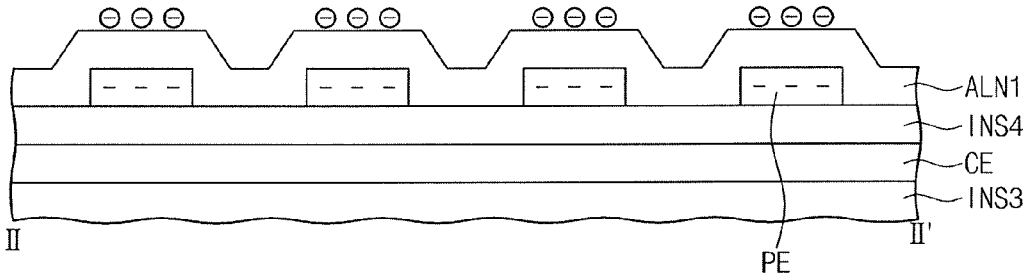

For convenience of description, in FIGS. 6B and 7B, the first alignment layer ALN1, the pixel electrode PE, and the common electrode CE in the cross-section cut along line II-II' of FIG. 2 are illustrated.

Figure 6C:
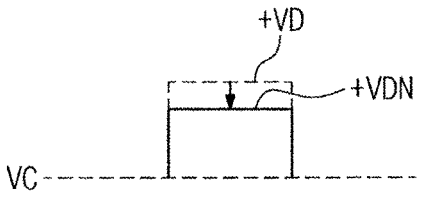

Referring to FIGS. 6A, 6B and 6C, a positive data voltage +VD of FIG. 6A may be applied to the pixel electrode PE. Thus, as illustrated in FIG. 6B, the pixel electrode may have a positive voltage.

A gravitational force is applied between negative ion particles of ion particles (or ion impurities) of the liquid crystal layer and the pixel electrode PE. The negative ion particles of the liquid crystal layer LC may be accumulated on the first alignment layer ALN1 disposed on the pixel electrode PE.

The ion particles may be accumulated on a surface of the first alignment layer ALN1 as a residual DC voltage. The negative ion particles accumulated on the first alignment layer ALN1 may affect the voltage level of the pixel electrode PE. For example, the negative ion particles may reduce a positive voltage level.

As illustrated in FIG. 6C, the voltage level of the pixel electrode PE may be reduced to a positive down data voltage +VDN having a level lower than that of the positive data voltage +VD by the negative ion particles accumulated on the first alignment layer ALN1.

Figure 7C:
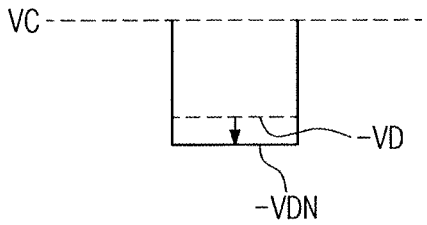

Referring to FIGS. 7A, 7B and 7C, after the positive data voltage +VD is applied to the pixel electrode PE, a negative data voltage −VD illustrated in FIG. 7A may be applied to the pixel electrode PE. Thus, as illustrated in FIG. 7B, the pixel electrode PE may have a negative voltage.

The negative ion particles accumulated on the first alignment layer ALN1 when the positive data voltage +VD is applied to the pixel electrode PE may be maintained in an accumulated state for a predetermined time while the negative data voltage −VD is applied to the pixel electrode PE.

In other words, even though the negative data voltage −VD is applied to the pixel electrode PE, the positive ion particles may not be immediately accumulated on the first alignment layer ALN1, the negative ion particles that are already accumulated on the first alignment layer ALN1 may be maintained in the accumulated state.

As illustrated in FIG. 7C, the voltage level of the pixel electrode PE may be reduced to a negative down data voltage −VDN having a level lower than that of the negative data voltage −VD of the pixel electrode PE due to the negative ion particles accumulated on the first alignment layer ALN1.

A phenomenon in which the ion particles are accumulated, and thus, causing the voltage level of the pixel electrode PE to be changed may be referred to as a direct current (DC) accumulation phenomenon. Even though the positive and negative data voltages +VD and −VD having the same intensity (or amplitude) are applied to the pixel electrode PE, the voltage level of the pixel electrode PE may be changed by a negative DC accumulation phenomenon. As a result, the positive down data voltage +VDN may have an intensity less than that of the negative down data voltage −VDN.

When the negative and positive data voltages are applied to the pixel electrode PE, the level of the data voltage of the pixel electrode PE may be changed by a positive DC accumulation phenomenon contrary to that in FIGS. 6A, 6B, 6C, 7A, 7B and 7C.

Figure 8:
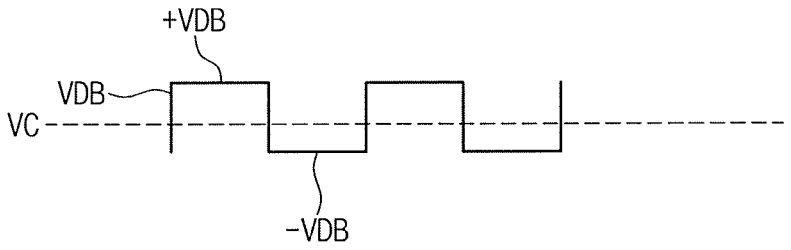
FIG. 8 is a view showing a black data voltage applied to a black pattern according to an exemplary embodiment of the inventive concept.

FIG. 8 is a view showing a black data voltage applied to a black pattern according to an exemplary embodiment of the inventive concept.

Referring to FIG. 8, a black data voltage VDB corresponding to the black pattern image signals for displaying the black pattern of the image signals may include a positive black data voltage +VDB and a negative black data voltage −VDB. For example, the black data voltage VDB corresponding to the black pattern image signals may be a voltage to be applied to the second pixels PX2 displaying the black pattern in the checker pattern of FIG. 4.

The data processing unit 121 may convert the data values of the black pattern image signals so that the black pattern image signals are biased to a positive polarity with respect to the common voltage VC. Thus, as illustrated in FIG. 8, in the black data voltage VDB corresponding to the black pattern image signals, the positive black data voltage +VDB has an intensity that is greater than that of the negative black data voltage −VDB with respect to the common voltage.

The black data voltage VDB may be less than a threshold voltage at which the liquid crystal molecules of the liquid crystal layer LC are driven. The threshold voltage for driving the liquid crystal molecules of the liquid crystal layer LC may be about 500 mV. Each of the positive black data voltage +VDB and the negative black data voltage −VDB has an intensity that is less than voltage of about 500 mV. Thus, the liquid crystal moles may not be driven, even though the black data voltage VDB is converted to be biased to the positive polarity. This way, a luminance change may not occur.

Since the positive black data voltage +VDB has an intensity that is greater than that of the negative black data voltage −VDB, more negative ion particles may be accumulated on the first alignment layer ALN1 disposed on the pixel electrode PE. In other words, the negative DC accumulation may occur in the second pixels PX2, and the negative DC accumulation phenomenon may be accelerated.

Figure 9:
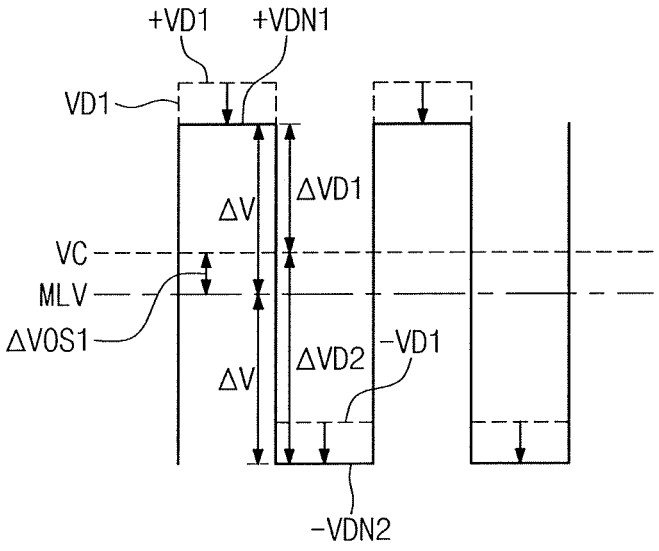
FIG. 9 is a view showing voltage levels of pixel electrodes of pixels driven at a first temperature to display the low gray scale according to an exemplary embodiment of the inventive concept.
Figure 10:
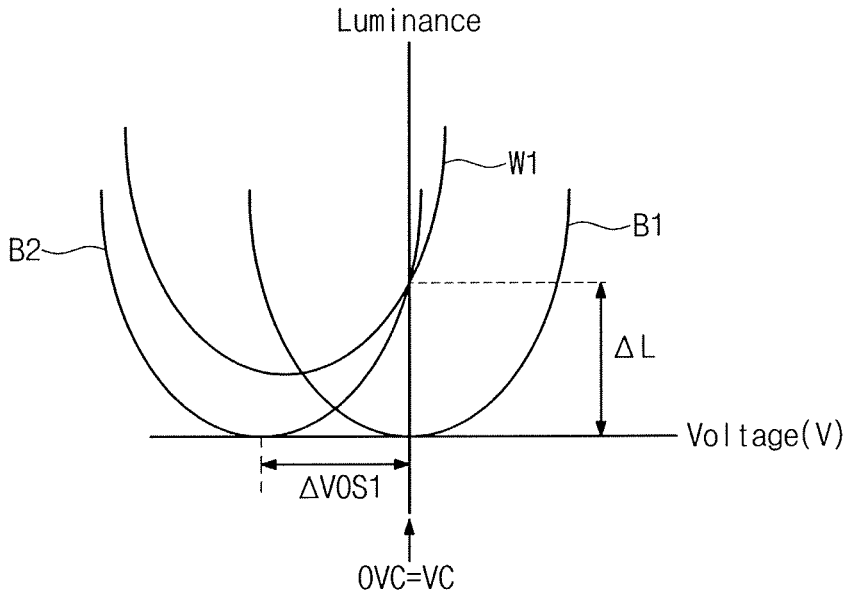
FIG. 10 is a view showing luminance curves of the pixels according to the voltage levels of the pixel electrode of FIG. 9, according to an exemplary embodiment of the inventive concept.

FIG. 9 is a view showing voltage levels of pixel electrodes of pixels driven at a first temperature to display the low gray scale according to an exemplary embodiment of the inventive concept. FIG. 10 is a view showing luminance curves of the pixels according to voltage levels of the pixel electrode of FIG. 9, according to an exemplary embodiment of the inventive concept.

The first temperature may be a temperature that is greater than or equal to the reference temperature. The reference temperature may be about 40° C. For example, the luminance curve of FIG. 10 may be a graph showing luminance measured from the pixels PX driven at a temperature of about 60° C.

Hereinafter, when the black data voltage VDB of FIG. 8 is applied to the checker pattern of FIG. 4, and then the pixels PX display the low gray scale, the luminance of the pixels PX will be exemplarily described. In addition, for convenience of description, the luminance of the pixels PX will be described by using the first and the second pixels PX1 and PX2 of FIG. 4.

Referring to FIGS. 9 and 10, when the pixels PX are driven at the first temperature, the data driver 140 may provide a first data voltage VD1 for displaying the low gray scale to the pixels PX. The first data voltage VD1 may be a data voltage for displaying 32 gray scales of the low gray scale.

The first data voltage VD may include a positive first data voltage +VD1 and a negative first data voltage −VD1. When the image signals RGB are low gray scale image signals at the first temperature, the data processing unit 121 may not change the data values of the low gray scale image signals. In this case, the positive first data voltage +VD1 and the negative first data voltage −VD1 outputted from the data driver 140 with respect to the common voltage VC may have the same intensity.

As described above, since the positive first data voltage +VD1 and the negative first data voltage −VD1 have the same intensity with respect to the common voltage VC, the optimal common voltage OVC and the common voltage VC may have the same level.

The positive and negative first data voltages +VD1 and −VD1 are applied to the pixel electrode PE of the pixel PX. As described above, the negative ion particles are accumulated on the first alignment layer ALN1 disposed on the pixel electrode PE due to the black data voltage VDB. The negative ion particles accumulated on the first alignment layer ALN1 may be maintained in the accumulated state for a predetermined time even though the pixels PX display the low gray scale. In this case, the voltage level of the pixel electrode PE may be changed by the above-described negative DC accumulation phenomenon.

The voltage level of the pixel electrode PE to which the positive first data voltage +VD1 is applied by the negative ion particles accumulated on the first alignment layer ALN1 may be reduced to a positive first down data voltage +VDN1 having a level lower than that of the positive first data voltage +VD1. In addition, the voltage level of the pixel electrode PE to which the negative first data voltage −VD1 is applied may be reduced to a negative first down data voltage −VDN1 having a level lower than that of the negative first data voltage −VD1.

The positive first down data voltage +VDN1 has an intensity ΔVD1 that is less than that ΔVD2 of the negative first down data voltage −VDN1 with respect to the common voltage VCOM.

A second black curve B2 illustrated in FIG. 10 represents a luminance curve of the second pixel PX2 when the second pixel PX2 displays the low gray scale, after the black data voltage of FIG. 8 is applied to the second pixel PX2 that displays the black gray scale of the checker pattern.

The positive first down data voltage +VDN1 may have the same intensity ΔVD as that ΔVD of the negative first down data voltage −VDN1 with respect to an intermediate level voltage MLV of the positive first down data voltage +VDN1 and the negative first down data voltage −VDN1.

The sum of the luminance may be zero at a point of the intermediate level voltage MLV where the intensity ΔVD of the positive first down data voltage +VDN1 and the intensity ΔVD of the negative first down data voltage −VDN1 are the same. The intermediate level voltage MLV may have a level lower than that of the common voltage VC due to a first offset voltage ΔVOS1.

Thus, the lowest point of the second black curve B2 may be disposed on a point corresponding to the intermediate level voltage MLV, which is a point at which the luminance is zero. In other words, the lowest point of the second black curve B2 is the point at which the luminance is zero. As a result, the luminance curve of the second pixels PX2 that display the low gray scale after displaying the black gray scales of the checker pattern may move from the first black curve B1 to the second black curve B2 as illustrated in FIG. 10.

A point at which the first white curve W1 meets the second black curve B2 coincides with a point of the common voltage VC where a user sees the image. Thus, the first and second pixels PX1 and PX2 may have the same luminance at the point at which the first white curve W1 meets the second black curve B2. Accordingly, a luminance difference may not be generated.

Since the first and second pixels PX1 and PX2 displaying the low gray scale have the same luminance, the luminance difference may not be seen by the user. Since the luminance difference is not seen in the low gray scale, the afterimage is not seen even though the image in the low gray scale is displayed at a first temperature after displaying the checker pattern.

In other words, in an exemplary embodiment of the inventive concept, the data processing unit 121 may change the level of the black data voltage for displaying the black patterns so that the black data is biased to a positive polarity to generate the negative DC accumulation so that the luminance difference between the first and second pixels PX1 and PX2 is not generated at the first temperature. Thus, the display apparatus 100 according to an exemplary embodiment of the inventive concept may reduce the afterimage by using the DC accumulation at the first temperature.

Although it is described that the second black curve B2 may move to a left side of the first black curved B1, the present inventive concept is not limited thereto. For example, the level of the black data voltage VDB may be changed so that the black data voltage VDB is biased to a negative polarity, to generate the positive DC accumulation to allow the intermediate level voltage MLV to be set higher than the common voltage VC. In this case, the second black curve B2 may move to a right side of the first black curve B1, and the luminance difference may not be generated with respect to the common voltage VC.

Figure 11:
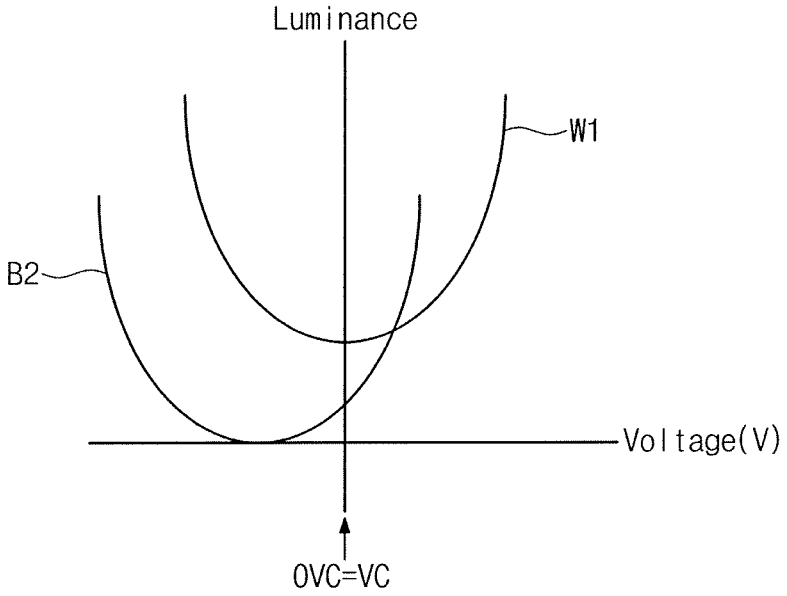
FIG. 11 is a view showing luminance curves of the pixels driven at a second temperature to display the low gray scale after the black data voltage of FIG. 8 is applied to second pixels, according to an exemplary embodiment of the inventive concept.

FIG. 11 is a view showing luminance curves of the pixels driven at a second temperature to display the low gray scale after the black data voltage of FIG. 8 is applied to second pixels, according to an exemplary embodiment of the inventive concept.

A second temperature may be a temperature less than the reference temperature. For example, the luminance curve of FIG. 11 may be a graph of the luminance measured in the pixels PX driven at a temperature of about 30° C.

Referring to FIG. 11, the luminance curve of the pixels PX driven at the second temperature and displaying the low gray scale is different from that of FIG. 10. In other words, the luminance curve may vary according to the temperature.

When a DC afterimage is applied by changing the black data voltage VDB, the afterimage may be reduced at the first temperature. However, the temperature may be changed to the second temperature when the DC afterimage is applied; thus, the first white curve W1 and the second black curve B2 may be changed as illustrated in FIG. 11. Thus, a luminance difference may occur at the common voltage VC point.

Figure 12:
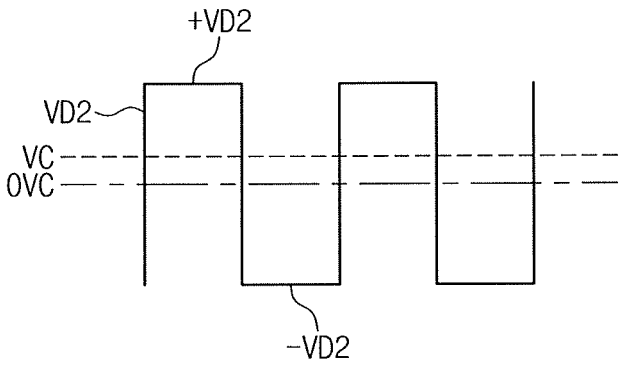
FIG. 12 is a view showing data voltages applied to the pixels driven at the second temperature to display the low gray scale according to an exemplary embodiment of the inventive concept.
Figure 13:
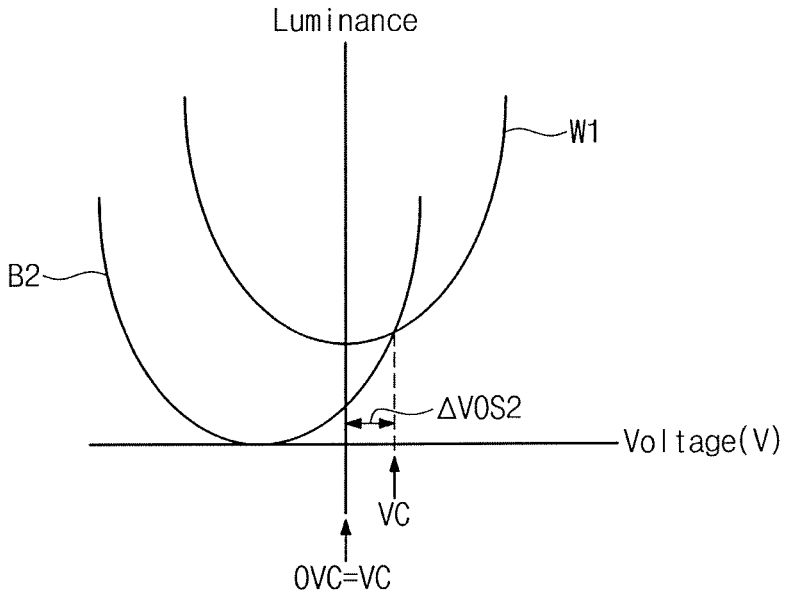
FIG. 13 is a view showing luminance curves of the pixels according to the data voltages of FIG. 12, according to an exemplary embodiment of the inventive concept.

FIG. 12 is a view showing data voltages applied to the pixels driven at the second temperature to display the low gray scale according to an exemplary embodiment of the inventive concept, and FIG. 13 is a view showing luminance curves of the pixels according to the data voltages of FIG. 12, according to an exemplary embodiment of the inventive concept.

Referring to FIG. 12, when the pixels PX are driven at the second temperature, the data driver 140 provides a second data voltage VD2 for displaying the low gray scale to the pixels PX. For example, the second data voltage VD2 may be a data voltage for displaying 8 gray scales. The second data voltage VD2 includes the positive second data voltage +VD2 and a second data voltage −VD2.

The data processing unit 121 may change the data values of the low gray scale image signals for displaying the low gray scale at the second temperature so that the low gray scare image signals are biased to a negative polarity with respect to the common voltage VC. In this case, the positive second data voltage +VD2 has an intensity that is less than that of the negative second data voltage −VD2, which are generated from the data driver 140 with respect to the common voltage VC.

The optimal common voltage OVC that is an intermediate level of the positive second data voltage +VD2 and the negative second data voltage −VD2 outputted from the data driver 140 may be lower than the common voltage VC. In other words, when the positive data voltage and the negative data voltage outputted from the data driver 140 has an intensity different from each other, a level of the optimal common voltage OVC may be different from that of the common voltage VC as illustrated in FIGS. 12 and 13.

Although an absolute value level of the common voltage VC applied to the common electrode CE is not substantially changed, the second data voltage VD2 is biased to the negative polarity, and thus the level of the common voltage VC may be relatively higher than the optimal common voltage OVC.

In other words, the common voltage VC may have a level higher than the optimal common voltage OVC by a second offset voltage ΔVOS2. Thus, as illustrated in FIG. 13, the point of the common voltage VC may move to a right side of the optimal common voltage OVC due to the second offset voltage ΔVOS2.

The point from which the image is seen may be a point of the common voltage VC. The point at which the first white curve W1 meets the second black curve B2 coincides with the point of the common voltage VC. Since the first pixels PX1 and the second pixels PX2 have the same luminance at the point at which the first white curve W1 meets the second black curve B2, the luminance difference between the first and second pixels PX1 and PX2 may not be generated. Thus, the luminance difference may not be seen to the user. Since the luminance difference is not seen in the low gray scale, even though the image in the low gray scale is displayed after displaying the checker pattern, the afterimage is not seen.

In other words, in an exemplary embodiment of the inventive concept, the data processing unit 121 may change the data values of the low gray scale image signals so that the point of the common voltage VC coincides with the point at which the first white curve W1 meets the second black curve B2. Thus, the display apparatus 100 according to an exemplary embodiment of the inventive concept may change the data values of the low gray scale image signals at the second temperature to reduce the afterimage.

Although it is described that the common voltage VC may have a level relatively higher than that of the optimal common voltage OVC, the present inventive concept is not limited thereto. For example, when the second black curve B2 moves to the right side of the first white curve W1, the data values of the low gray image signals may be changed to be biased to the positive polarity with respect to the common voltage VC so that the common voltage VC has a level relatively lower than the optimal common voltage VC at the second temperature.

The AC afterimage may affect the luminance regardless of the temperature; however, the DC afterimage has a less effect on the luminance at a relatively lower temperature. Since the pixels PX are driven at the second temperature that is lower than the first temperature, the effect of the DC afterimage generated according to the DC accumulation may be neglected even though the level of the second data voltage VD is changed to be biased to one polarity.

Hereinafter, constitutions of the above-described data processing unit 121 performing an afterimage reduction operation when the low gray scale image is displayed will be described.

Figure 14:
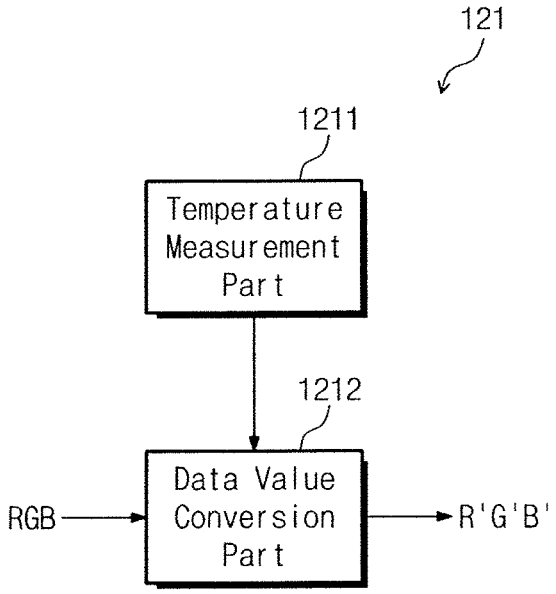
FIG. 14 is a diagram illustrating constitutions of a data processing unit of FIG. 1, according to an exemplary embodiment of the inventive concept.

FIG. 14 is a diagram illustrating constitutions of a data processing unit of FIG. 1, according to an exemplary embodiment of the inventive concept.

Referring to FIG. 14, the data processing unit 121 includes a temperature measurement part 1211 and a data value conversion part 1212.

The temperature measurement part 1211 may measure a surrounding temperature to provide the surrounding temperature as temperature information to the data value conversion part 1212. The surrounding temperature measured by the temperature measurement part 1211 may be a temperature of the display apparatus 100.

The data value conversion part 1212 may convert the data values of the black pattern image signals of the image signals RGB. For example, as illustrated in FIG. 8, the data value conversion part 1212 may change the data values of the black pattern image signals so that the black pattern image signals are biased to one polarity with respect to the common voltage VC. Thus, the DC accumulation phenomenon may occur as described above.

When the data value conversion part 1212 receives the low gray scale image signals RGB, the data value conversion part 1212 may determine whether the data values of the image signals are converted according to the temperature information.

When the temperature information is the first temperature, the data value conversion part 121 may output the data values of the low gray scale image signals without changing the data values as described with reference to FIGS. 9 and 10. Thus, the data driver 140 may provide the first data voltage VD1 of which the positive voltage and the negative voltage have the same intensity to the pixels PX. In this case, the afterimage is reduced as described in reference to FIGS. 9 and 10.

When the temperature information is the second temperature, the data value conversion part 1212 may convert and output the data values of the low gray scale image signals as described with reference to FIGS. 12 and 13. For example, the data value conversion part 1212 may convert the data value of the low gray scale image signals so that the low gray scale image signals are biased to the negative polarity with respect to the common voltage VC. Thus, the data driver 140 may provide the positive second data voltage +VD2 and the negative second data voltage −VD2 having an intensity that is greater than that of the second data voltage +VD2 to the pixels PX. In this case, description in which the afterimage is reduced as described in reference to FIGS. 12 and 13.

Image signals R'G'B' outputted from the data value conversion part 1212 may be changed in data format and then be provided to the data driver 140.

As a result, the display apparatus 100 according to an exemplary embodiment of the inventive concept may improve the afterimage by using the DC accumulation and changing the data values of the image signals R'G'B' according to the temperature.

The display apparatus 100 and the method of driving the display apparatus 100 according to exemplary embodiments of the inventive concept may reduce or eliminate the afterimage.

Although the present inventive concept has been shown and described with reference to exemplary embodiments thereof, it is understood by those of ordinary skill in the art that various changes in form and detail can be made thereto without departing from the spirit and scope of the present inventive concept as hereinafter claimed.

What is claimed is:

1. A display apparatus comprising:

a timing controller for converting data values of black image signals to be biased to one polarity with respect to a common voltage and for converting data values of low gray scale image signals to be biased to one polarity with respect to the common voltage, wherein the low gray scale image signals display a gray scale equal to or less than a reference gray scale at a temperature lower than a reference temperature;

a data driver for converting the image signals outputted from the timing controller into data voltages; and a plurality of pixels for receiving the data voltages in response to gate signals to display an image.

2. The display apparatus of claim 1, wherein the timing controller comprises a data processing unit for converting the data values of the black image signals to be biased to one polarity with respect to the common voltage and the data values of the low gray scale image signals to be biased to one polarity with respect to the common voltage at a first surrounding temperature, but not converting the data values of the low gray scale image signals at a second surrounding temperature, thereby outputting the converted image signals, wherein the first surrounding temperature is lower than the reference temperature and the second surrounding temperature is equal to or higher than the reference temperature.

3. The display apparatus of claim 2, wherein the data processing unit comprises:

a temperature measurement part for measuring and outputting temperature information; and a data value conversion part for converting the data values of the black image signals to be biased to one polarity with respect to the common voltage and the data values of the low gray scale image signals to be biased to one polarity with respect to the common voltage at the first surrounding temperature but not converting the data values of the low gray scale image signals at the second surrounding temperature, thereby outputting the converted black image signals and the low gray scale image signals.

4. The display apparatus of claim 2, wherein a level of the data voltages corresponding to the black image signals is less than about 500 mV.

5. The display apparatus of claim 2, wherein the reference gray scale is 32 grayscales when full white is 64 grayscales.

6. The display apparatus of claim 2, wherein the reference temperature is about 40° C.

7. The display apparatus of claim 2, wherein the data processing unit converts the data values of the black image signals to be biased to a positive polarity with respect to the common voltage.

8. The display apparatus of claim 7, wherein the data processing unit converts the data values of the low gray scale image signals at the first surrounding temperature to be biased to a negative polarity with respect to the common voltage.

9. The display apparatus of claim 2, wherein the data processing unit converts the data values of the black image signals to be biased to a negative polarity with respect to the common voltage.

10. The display apparatus of claim 9, wherein the data processing unit converts the data values of the low gray scale image signals at the first surrounding temperature to be biased to a positive polarity with respect to the common voltage.

11. The display apparatus of claim 1, wherein each of the pixels comprises:

a first substrate and a second substrate disposed to face each other; and a liquid crystal layer disposed between the first and second substrates, wherein the first substrate comprises:

a transistor receiving the data voltage in response to a corresponding gate signal of the gate signals;

a pixel electrode receiving the data voltage through the transistor; and a common electrode disposed to be insulated from the pixel electrode, wherein the pixel electrode comprises:

a plurality of branch parts spaced a predetermined distance apart from each other in a first direction to extend in a second direction that intersects the first direction;

a first connection part connecting first sides of the branch parts to each other; and a second connection part connecting second sides of the branch parts to each other.

12. A method of driving a display apparatus, the method comprising:

converting data values of black image signals to be biased to one polarity with respect to a common voltage;

converting and outputting low gray image signals at a first surrounding temperature to be biased to one polarity with respect to the common voltage, but not converting the gray image signals at a second surrounding temperature;

converting the outputted image signals into data voltages; and providing the data voltages to pixels in response to gate signals, wherein the gray image signals display a gray scale equal to or less than a reference gray scale, wherein the first surrounding temperature is lower than the reference temperature and the second surrounding temperature is equal to or higher than the reference temperature.

13. The method of claim 12, further comprising measuring the first and second surrounding temperatures.

14. The method of claim 12, wherein a level of the data voltages corresponding to the black image signals is less than about 500 mV.

15. The method of claim 12, wherein the reference gray scale is 32 grayscales when full white is 64 grayscales.

16. The method of claim 12, wherein the reference temperature is about 40° C.

17. The method of claim 12, wherein the data values of the black image signals are converted to be biased to a positive polarity with respect to the common voltage.

18. The method of claim 17, wherein the data values of the low gray scale image signals are converted at the first surrounding temperature to be biased to a negative polarity with respect to the common voltage.

19. The method of claim 12, wherein each of the pixels comprises:

a first substrate and a second substrate disposed to face each other; and a liquid crystal layer disposed between the first and second substrates, wherein the first substrate comprises:

a transistor receiving a corresponding data voltage of the data voltages in response to a corresponding gate signal of the gate signals;

a pixel electrode receiving the data voltage through the transistor; and a common electrode disposed to be insulated from the pixel electrode, wherein the pixel electrode comprises:

a plurality of branch parts spaced a predetermined distance apart from each other in a first direction to extend in a second direction that intersects the first direction;

a first connection part connecting first sides of the branch parts to each other; and a second connection part connecting second sides of the branch parts to each other.

* * * * *